US007428312B2

(12) United States Patent
Meier et al.

(10) Patent No.: US 7,428,312 B2
(45) Date of Patent: Sep. 23, 2008

(54) METHOD FOR ADAPTING A HEARING DEVICE TO A MOMENTARY ACOUSTIC SITUATION AND A HEARING DEVICE SYSTEM

(75) Inventors: Hilmar Meier, Zürich (CH); Michael Boretzki, Rüti (CH); Herbert Bächler, Meilen (CH); Stefan Launer, Zürich (CH)

(73) Assignee: Phonak AG, Stafa (CH)

( * ) Notice: Subject to any disclaimer, the term of this patent is extended or adjusted under 35 U.S.C. 154(b) by 237 days.

(21) Appl. No.: 10/716,231

(22) Filed: Nov. 18, 2003

(65) Prior Publication Data

US 2004/0190738 A1 Sep. 30, 2004

Related U.S. Application Data

(63) Continuation-in-part of application No. 10/400,842, filed on Mar. 27, 2003, now abandoned.

(51) Int. Cl.
*H04R 25/00* (2006.01)

(52) U.S. Cl. ..... 381/312; 381/314

(58) Field of Classification Search ..... 381/314, 381/315, 320, 312, 321, 323, 60; 73/585; 600/559; 704/255, 271
See application file for complete search history.

(56) References Cited

U.S. PATENT DOCUMENTS 4,425,481 A * 1/1984 Mansgold et al. ..... 381/317
4,947,432 A * 8/1990 Topholm ..... 381/315
5,303,306 A * 4/1994 Brillhart et al. ..... 381/315
5,604,812 A 2/1997 Meyer
5,636,285 A * 6/1997 Sauer ..... 381/314
6,175,635 B1 1/2001 Meyer et al.
2002/0037087 A1 3/2002 Allegro et al. ..... 381/317
2002/0090098 A1 7/2002 Allegro et al.

FOREIGN PATENT DOCUMENTS

EP 0 964 603 A1 12/1999
WO 01/20965 1/2001

* cited by examiner

*Primary Examiner*—Huyen D Le
(74) *Attorney, Agent, or Firm*—Pearne & Gordon LLP

(57) ABSTRACT

In a signal processing unit of a hearing device, the signal processing unit consisting of a signal analyzing unit and a signal identification unit, the momentary acoustic surround situation is identified. Based on this identified surround situation, the parameter set belonging to the identified surround situation is automatically adjusted in a transmission unit in which a number of parameter sets are saved which are assigned to different acoustic surround situation. The hearing device user can adjust his individual hearing desire for each acoustic surround situation according to the automatic adjusted parameter set with the aid of an input unit. Thereby, the parameter of this parameter set are adjusted at the same time and commonly in one of two opposing directions, e.g. in the sense of "better hearing" or in the sense of "more pleasant understanding".

25 Claims, 2 Drawing Sheets

METHOD FOR ADAPTING A HEARING DEVICE TO A MOMENTARY ACOUSTIC SITUATION AND A HEARING DEVICE SYSTEM

CROSS-REFERENCE TO RELATED APPLICATION

This application is a Continuation-In-Part of U.S. utility patent application Ser. No. 10/400,842 filed Mar. 27, 2003.

FIELD OF THE INVENTION

The present invention is related to a method for adapting a hearing device, in particular a hearing aid, to a momentary acoustic surround situation, as well as to a hearing device system with a hearing device or hearing-aid, respectively.

BACKGROUND OF THE INVENTION

A method and a hearing device system of this kind are known from WO-A-01/20965 or from the corresponding US-A-2002/0037087. By this known solution, the momentary acoustic surround situation is identified in the hearing device of the hearing device system, and the corresponding hearing program, i.e. the corresponding set of parameters saved in the hearing device, is automatically adjusted according to the identified acoustic surround situation. In order to provide the possibility to the hearing device user to switch off, as he wishes, the automatic recognition of the acoustic surround situation and the corresponding automatic selection of the hearing program, an input unit, e.g. a switch at the hearing device or at a remote control, is provided which can be operated by the hearing device user.

Besides that, hearing devices are also known for which the selection of the suitable hearing program can be manually made by the hearing device user from a number of hearing programs saved in the hearing device, and, to be precise, over a remote control or over a switch at the hearing device. For a lot of users, the switching between different hearing programs is however tiresome or difficult, in particular then when a lot of hearing programs are provided for selection.

The present invention has therefore the object to provide a method and a hearing device system, respectively, of the kind mentioned above, for which the hearing program corresponding to the momentary acoustic surround situation is manually or automatically adjusted, the hearing device user having the possibility to introduce his personal hearing wish optimally.

SUMMARY OF THE INVENTION

In a signal processing unit of a hearing device, the signal processing unit consisting of a signal analyzing unit and a signal identification unit, the momentary acoustic surround situation is identified. Based on this identified surround situation, the parameter set belonging to the identified surround situation is automatically adjusted in a transmission unit in which a number of parameter sets are saved which are assigned to different acoustic surround situation. In a simplified embodiment of the present invention, a manual selection of a desired hearing program is also proposed. The hearing device user can adjust his individual hearing wish for each acoustic surround situation according to the manual or automatic adjusted parameter set with the aid of an input unit. Thereby, the parameter of this parameter set are adjusted at the same time and commonly in one of two opposing directions, e.g. in the sense of "better hearing" or in the sense of "more pleasant understanding".

The hearing device user can therefore take influence on the hearing program manually or automatically selected by the hearing device of the hearing device system, i.e. by the set of parameters corresponding to the selected hearing program, in that the hearing device user adjusts the parameters with the aid of an input unit simply operable according to predefined rules saved in the hearing device. Therewith, the hearing device user is capable to adjust the hearing program in every surround situation in an easy manner, the hearing program being adjusted to this specific surround situation and according to his personal desire, as e.g. in the sense of "better understanding" or "more pleasant hearing".

Preferably, the parameters of the adjusted parameter set are adjusted starting from an adjusted nominal value within a preset rule range according to preset rules in one of two opposing directions.

Additional features of the present invention will become apparent to those skilled in the art upon consideration of the following detailed description of preferred embodiments.

DETAILED DESCRIPTION OF THE INVENTION

Figure 1:
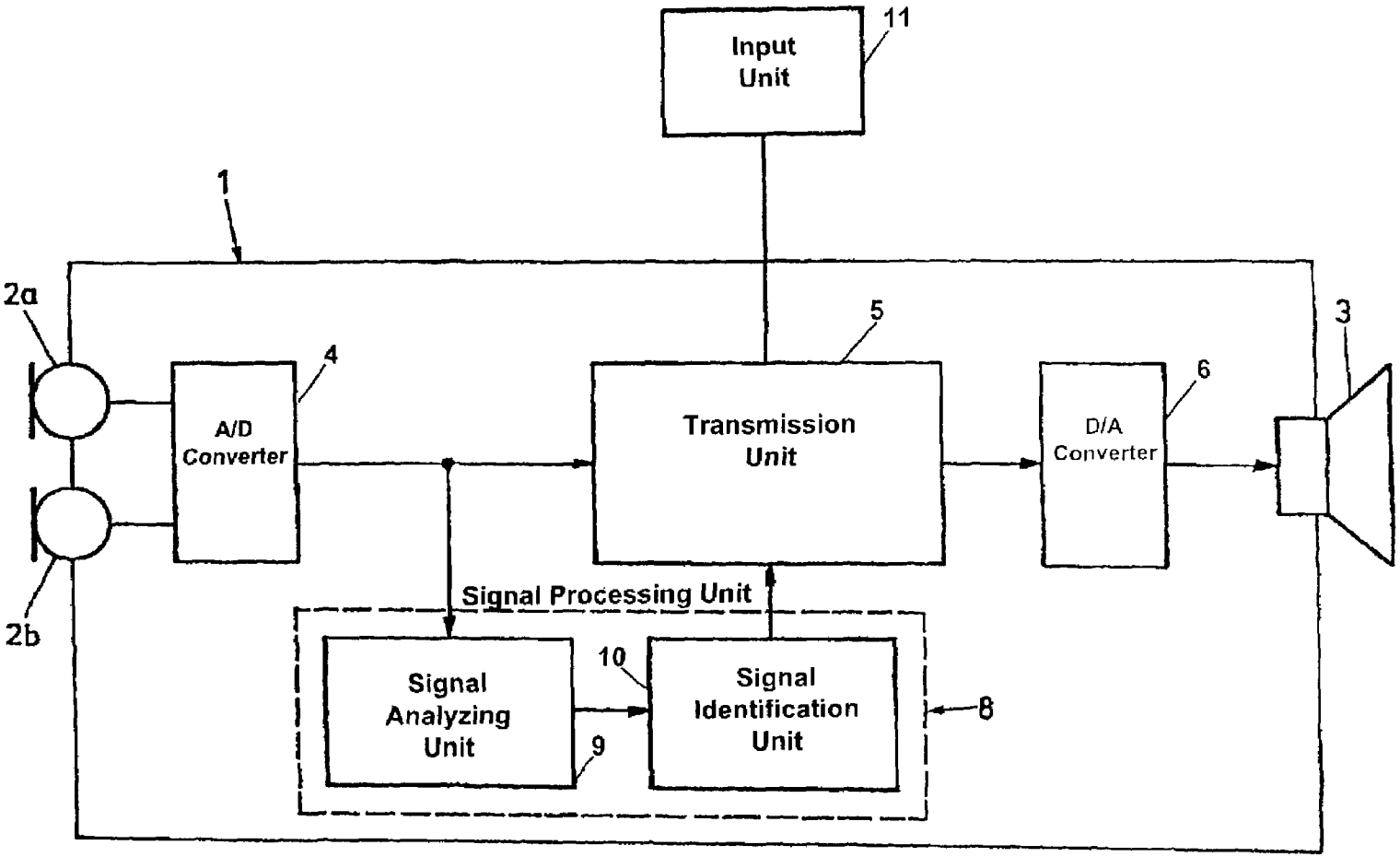
FIG. 1 shows a block diagram of a hearing device system according to the present invention.
Figure 2:
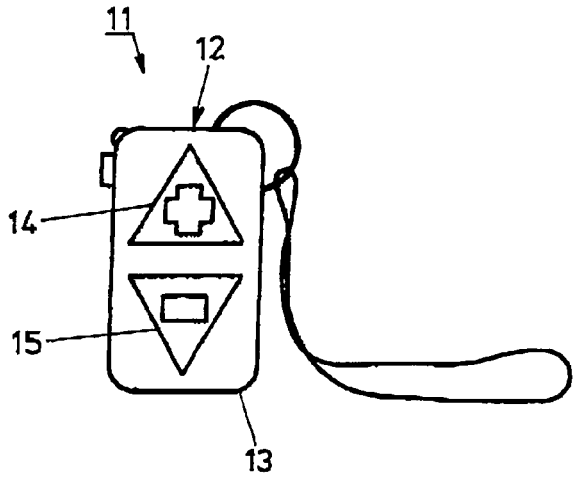
FIG. 2 shows an embodiment of an input unit belonging to the hearing device system according to FIG. 1.
Figure 3:
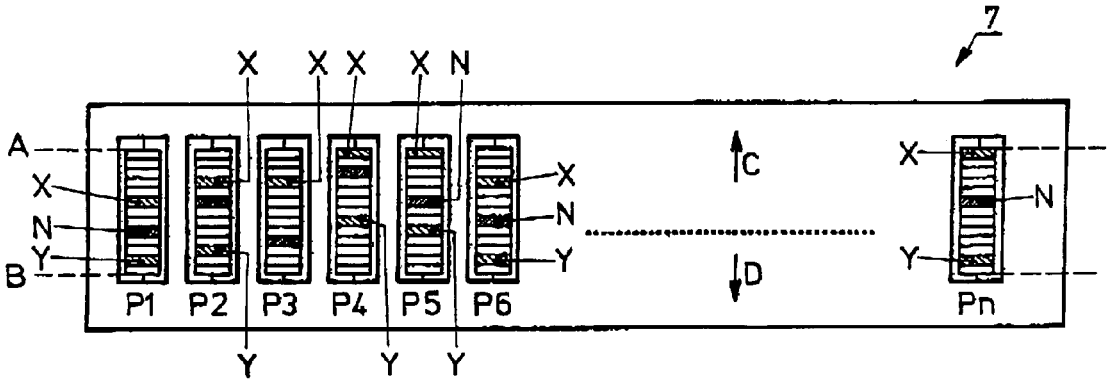
FIG. 3 shows a representation of a parameter set.

The hearing device system represented in FIG. 1 as a block diagram has a hearing device 1, which consists of electroacoustic converters, namely at least one microphone, preferably two microphones 2*a*, 2*b* as shown, as well as a receiver 3 (loudspeaker). The microphones 2*a*, 2*b* are connected to the input of a transmission unit 5 adjustable in its transmission characteristics over an analog to digital converter 4, the transmission unit 5 being connected at its output end to the receiver 3 over a digital to analog converter 6. In the transmission unit 5 a number of different sets of parameters are saved, of which each is assigned to a certain acoustic surrounding situation and determines a transmission characteristic of the transmission unit 5. Such a parameter set 7 is schematically represented in FIG. 3. Furthermore, a signal processing unit 8 belongs to the hearing device 1, which signal processing unit 8 consists of a signal analyzing unit 9 and a signal identification unit 10 connected with the signal analyzing unit 9. The signal analyzing unit 9 is connected to the output of the analog to digital converter 4 and is fed at its input end by the input signal of the transmission unit 5. The output of the signal identification unit 10 is connected to the transmission unit 5, to which, furthermore, an input unit 11 is operationally connected. This input unit 11 consists of a remote control unit 12 separated from the hearing device for the shown implemented example, which remote control unit 12 is wirelessly connected to the hearing device 1. This remote control unit 12, only schematically represented in FIG. 2, has a housing 13 in which the necessary electronic components, not further represented, are incorporated as well as two buttons 14 and 15, which are easily identifiable by the hearing device user, according to the shown embodiment by "+" (meaning e.g. "better understanding) and "−" (meaning e.g. "more pleasant hearing").

It is also possible to integrate the input unit 11—instead of having a remote control unit 12—into the hearing device 1 and to provide two buttons at the hearing device.

The input unit 11 can also be designed that the input is generated by the hearing device user through speech control.

The identification of the momentary acoustic surround situation and the automatic adjustment of a hearing program or set of parameters, respectively, belonging to the identified surround situation, can basically be done as has been already described in WO-A-01/20965 and US-A-2002/0037087. Therefore, reference is made to these printings for a detailed description of the automatic adjustment of the suitable hearing program, which printings are herewith incorporated by reference into this description. As a summary, the automatic hearing program adjustment is performed as follows:

In the signal analysis unit 9 characteristic, auditory-based features and, if need be, also technically-based features are extracted from the output of the analog to digital converter 4. Based on the features extracted in the signal analysis unit 9, the momentary acoustic surround situation is determined by recognition of the same or a similar pattern of the extracted features, and a corresponding signal is generated. This output signal, which contains information of the acoustic surround situation, is fed to the transmission unit 5 in which the set of parameters is adjusted determining the momentary transmission characteristic of the transmission unit 5, which set of parameters is related to the identified acoustic surround situation.

A simplified embodiment compared to the one represented in FIG. 1 consists in that a signal processing unit 8 does not be absolutely provided, or at least in that the above-described function of the signal processing unit 8 can be put out of operation. For such a simplified embodiment of the present invention, a hearing program can be manually selected at the hearing device itself or over the remote control 12 by the hearing device user. Nevertheless, the set of parameters belonging to the selected hearing program is adjusted over the input unit according to preset rules recorded in the hearing device.

The hearing device user has also the possibility to have influence on the manually or automatically selected set of parameters as described above, i.e. on the adjusted hearing program. Thereto, the input unit 11 is used which, as already described, is operationally connected to the transmission unit 5. How this exertion of influence is taking place will be further described in the following by referring to FIG. 3.

It is assumed that the set of parameters 7 adjusted in the hearing device is shown in FIG. 3 and that this set of parameters 7 consists of the parameters P1-Pn. The nominal value adjusted for each parameter and saved in the transmission unit S is represented by a hatched beam and designated by N. By pushing the buttons 14, 15 the Parameters P1-Pn can be changed starting from this nominal value N going into two opposing directions C, D between two end values, which are referenced by A and B in FIG. 3 and which fix a control range. Thereby, not every one of the parameters P1-Pn can be adjusted, which would be very confusing and which would also not be handy. On the contrary, the change of the parameters P1-Pn is performed by pushing the buttons 14, 15 of the remote control unit 12 for all parameters at the same time and mutually according to predefined rules or set of rules, respectively, saved in the hearing device 1. For different acoustic surround situations, different rules or set of rules, respectively, can be applied. Thereby, every parameter of the adjusted set of parameters can be changed by a different measure, i.e. some of the parameters incur a strong change, whereas other parameters are only changed slightly or not at all. This will be further explained by referring to FIG. 3.

In a first case, one considers that the hearing device user has adjusted the parameters in direction of the arrow C by pressing the button 15 (adjusting in the sense of "more pleasant hearing"). The parameters are now adjusted to the value indicated by "X". In another case, the hearing device user has made a change of the parameters in direction of the arrow D by pressing the button 14 (adjusting in the sense of "better understanding") so that the parameters are now adjusted to the value indicated by Y. Thereby, the parameter P3 has not been changed in the represented example.

The adjustment of the parameters can be done stepwise or continuous as well as soft, i.e. not hearable, or hard, i.e. hearable.

Thanks to the method according to the present invention and by the hearing device system 1 according to the present invention, the hearing device user is capable to introduce or further introduce, respectively, his personal hearing desire, while at the same time an automatic as well as a manual selection of the hearing program best suitable to the momentary acoustic situation is taking place. This will be further clarified by an example.

The hearing device user is in a restaurant. In the background, music can be heard. At the same table, other people are sitting and are having a discussion. The hearing device is automatically or manually adjusting to this given momentary acoustic surround situation in the manner described above. The hearing device user can now have the desire to better follow up the discussions at the table, or he may want to hear the music better. In case he wants to follow the discussion better, he pushes the button 14 and adjusts the parameters Pl-Pn in direction of the arrow D in the sense of "better understanding, selective hearing or more intelligibility". In case the hearing device user wants to listen to the music, he pushes the other button 15 and adjusts the parameters P1-Pn in direction of the arrow C in the sense of "more pleasant hearing or better all-around hearing, respectively".

In the hearing device, a large number of different hearing programs, i.e. the corresponding sets of parameters, can be saved. In particular for a large number of different hearing programs, the best one is automatically being selected according to the momentary acoustic surround situation. The hearing device user can convert his desire in a simple manner, namely by pressing a button of a keyboard. Thereby, the hearing desire can change from one acoustic surround situation to the next one, but also within a given acoustic surrounding. The keyboard has only two buttons, but may also have more than two buttons. As a result, the concept according to the present invention makes it possible to create a hearing device which is easily operable and which is adjusting automatically, or if necessary also manually, to a momentary acoustic surround situation and which, in addition, is taking into account the particular hearing desire of a hearing device user.

The described hearing device 1 can be designed in such a way that the corrected sets of parameters, which have been changed by the hearing device user according to his hearing desire as described above, are saved in the hearing device. In case that the hearing device user changes the assigned parameter set originally saved always and again in the same manner in a certain acoustic surround situation, i.e. always in the same direction and to the same extent, this parameter set originally saved is exchanged by the changed corrected parameter set. The corrected parameter set is then used as standard adjustment.

This exchange of the originally saved parameter set by the corrected parameter set can automatically be learnt by the hearing device, e.g. by a neural network, or by a hearing device fitter or by the hearing device user himself.

The hearing device system described above is used in the sense of a hearing aid for the correction of a hearing impairment of a person. The method according to the present invention and the hearing device concept according to the present invention can be used similarly also for other acoustic communication systems, as e.g. for radio devices. Furthermore, the present invention is in particular very useful in connection with binaural hearing aids, wherein it is conceivable to information is recorded in one of the two hearing devices or in both hearing devices. In the case where information is only recorded in one of the two hearing devices, a first embodiment consists in recording information from both hearing devices. A second, and thus a simplified embodiment consists in recording of information of only one hearing device.

The invention claimed is:

1. A method for adapting a hearing device to a momentary acoustic surround situation, the method comprising the steps of:

identifying a momentary surround situation;

automatically adjusting parameters of a parameter set including parameters other than volume saved in the hearing device and belonging to the identified momentary surround situation; and manually adjusting, with the aid of an input unit operated by the hearing device user in accordance with the hearing desire of the hearing device user, parameters including parameters other than volume of said parameter set further in accordance with the hearing desire of the hearing device user so as to fine tune said parameter set.

2. The method of claim 1 further comprising the step of automatically identifying the momentary acoustic surround situation.

3. The method of claim 2 wherein the momentary acoustic surround situation is determined in the hearing device.

4. The method of claim 2 wherein characteristic features are being extracted in the hearing device first from signals which are recorded from the momentary acoustic surround situation, and then the momentary acoustic surround situation is being determined based on the extracted features.

5. The method of claim 1 further comprising the step of adjusting the parameters of the adjusted parameter set starting from an adjusted nominal value within a preset control range in one of two opposing direction.

6. The method of claim 1 wherein the parameters of the parameter set are being adjusted at the same time and commonly according to preset rules or rule sets, respectively.

7. The method of claim 6 wherein the adjustment of the parameters of the parameter set are being performed in the sense of "better understanding", at the one hand, and in the sense of "more pleasant hearing", at the other hand.

8. The method of claim 1 further comprising the step of selecting adjustable parameters as a function of the momentary acoustic surround situation.

9. The method of claim 1 further comprising the step of changing parameter values as a function of the momentary acoustic surround situation.

10. The method of claim 1 further comprising the step of saving the parameter sets adjusted in accordance to the hearing desire of the hearing device user.

11. The method of claim 3 further comprising the step of saving the parameter sets adjusted in accordance to the hearing desire of the hearing device user.

12. The method of claim 6 further comprising the step of saving the parameter sets adjusted in accordance to the hearing desire of the hearing device user.

13. The method of claim 7 further comprising the step of saving the parameter sets adjusted in accordance to the hearing desire of the hearing device user.

14. The method of one of the claims 10 to 12 wherein an originally saved parameter set assigned to a certain acoustic surround situation is being exchanged by a corresponding corrected parameter set adjusted by the hearing device user if, for this specific acoustic surround situation, the originally saved parameter set has been changed several times by the hearing device user in the same manner.

15. A hearing device system comprising:

a hearing device; and an input unit; wherein the hearing device comprises:

a transmission unit, at least one microphone, and a receiver, wherein the transmission unit, which, on its input side, is operationally connected to the at least one microphone and, on its output side, to the receiver and which is adjustable to different transmission characteristics determined by saved parameter sets including parameters other than volume to adjust its transmission characteristics, wherein the input unit is operable by the hearing device user and is operationally connected to the transmission unit, and wherein the parameters of the adjusted parameter sets resulting from the momentary transmission characteristics of the transmission unit are automatically adjustable according to the hearing desire of the hearing device user with the aid of the input unit, and wherein said parameters including parameters other than volume are further manually adjustable according to the hearing desire of the hearing device user so as to fine tune said parameters.

16. The hearing device system of claim 15, wherein the hearing device further comprises a signal processing unit to which the input signal of the transmission unit is being fed, the signal processing unit being able to identify the momentary acoustic surround situation, and wherein an adjustment of the parameter set belonging to the identified acoustic surround situation is effectuated in the transmission unit.

17. The hearing device system of claim 15, wherein the parameters of the adjusted parameter set are adjusted starting from an adjusted nominal value within a preset control range in one of two opposing directions with the aid of an input unit, the adjustment of the parameters of the parameter set being preferably adjusted at the same time and commonly according to preset rules or rule sets, respectively, saved in the hearing device.

18. The hearing device system of claim 15, wherein the adjustment of the parameters of the adjusted parameter set is done with the aid of the input unit in the sense of "better understanding", at one hand, and in the sense of "more pleasant hearing", on the other hand.

19. The hearing device system of claim 17, wherein the adjustment of the parameters of the adjusted parameter set is done with the aid of the input unit in the sense of "better understanding", at one hand, and in the sense of "more pleasant hearing", on the other hand.

20. The hearing device system of claim 16, wherein the signal processing unit comprises a signal analyzing unit operationally connected to at least one microphone, which signal analyzing unit extracts characteristic features from signals recorded by the at least one microphone from the momentary acoustic surround situation, as well as a signal identification unit connected to the output of the signal analyzing unit, on its output side, is connected to the transmission unit.

21. The hearing device system of one of the claims 15 to 20, wherein the input unit is designed to manually input data by a key board.

22. The hearing device system of one of the claims 15 to 20, wherein the input unit is designed for speech controlled input of data.

23. The hearing device system of one of the claims 15 to 20, wherein the input unit is designed as remote control separated from the hearing device and is connected to the transmission unit wirelessly.

24. The hearing device system of one of the claims 15 to 20, wherein the input unit is integrated into the hearing device.

25. The hearing device system of claim 20, wherein the key board of the input unit comprises two buttons of which each is used to adjust the parameters of a parameter set in one of the two opposing directions.

* * * * *